United States Patent [19]

Jank et al.

[11] Patent Number: 4,616,113

[45] Date of Patent: Oct. 7, 1986

[54] SAFETY CLIP FOR PROTECTING ARTICLES FROM THEFT

[75] Inventors: Wilhelm Jank, Industriestrasse 18, D-6794 Brücken/Pfalz; Karl Schneider, Herschweiler-Pettersheim, both of Fed. Rep. of Germany

[73] Assignee: Wilhelm Jank, Fed. Rep. of Germany

[21] Appl. No.: 706,591

[22] Filed: Feb. 28, 1985

[30] Foreign Application Priority Data

Feb. 29, 1984 [DE] Fed. Rep. of Germany ... 8406202[U]
Jun. 15, 1984 [DE] Fed. Rep. of Germany ..... 3422227

[51] Int. Cl.[4] ..... A41F 1/00; H01H 27/04

[52] U.S. Cl. ..... 200/61.13; 200/61.19; 24/510; 24/561; 24/562; 340/568

[58] Field of Search ..... 24/510, 561, 562, 564, 24/556, 567; 340/568; 200/61.13, 61.14, 61.19, 61.58

[56] References Cited

U.S. PATENT DOCUMENTS

| | | | |
|---|---|---|---|
| 788,548 | 5/1905 | Mouflier | 24/510 |
| 1,677,109 | 7/1928 | Korper | 24/510 |
| 2,401,413 | 6/1946 | Colwell | 24/510 |
| 2,908,899 | 10/1959 | Crafts | 200/61.19 |
| 3,137,027 | 6/1964 | Birkle | 24/562 |
| 3,204,636 | 9/1965 | Kariher et al. | 24/562 |
| 3,324,518 | 6/1967 | Louderback | 24/562 |
| 3,462,809 | 8/1969 | Froehlich, Jr. | 24/562 |
| 3,570,075 | 3/1971 | Louderback | 24/561 |
| 3,779,108 | 12/1973 | Reiter | 24/510 |
| 3,798,630 | 3/1974 | Crosthwait | 200/61.13 |

FOREIGN PATENT DOCUMENTS 2912008 3/1983 Fed. Rep. of Germany .

*Primary Examiner*—Victor N. Sakran
*Attorney, Agent, or Firm*—Neil F. Markva

[57] ABSTRACT

The safety clip contains two clip legs (11,12) between which a fabric (13) may be placed. One clip leg (11) is provided with a switch (15) whose actuator (16) is operated by the introduced fabric web (23). Bulges (19) provided around the movable actuator (16) ensure that a card cannot be slided between the clip legs to keep the actuator depressed while the fabric web (23) is being removed.

13 Claims, 7 Drawing Figures

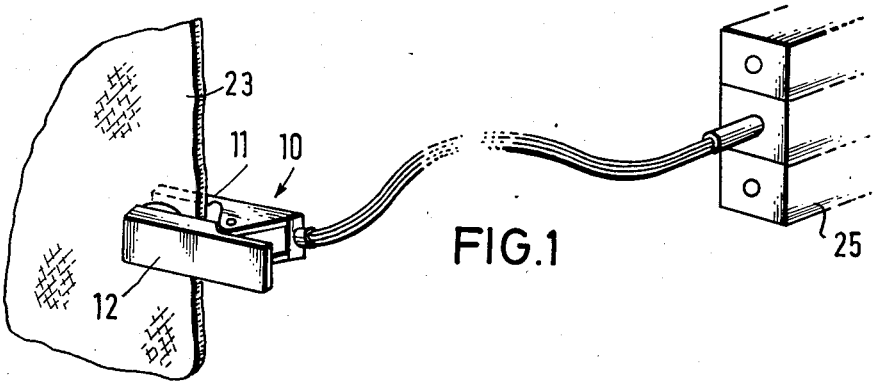
FIG.1
FIG.2
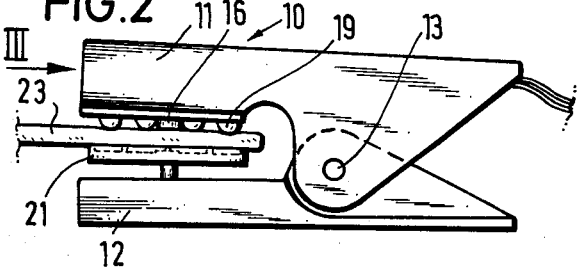
FIG.3
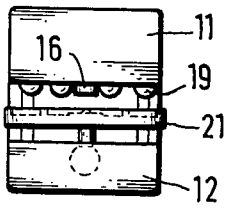
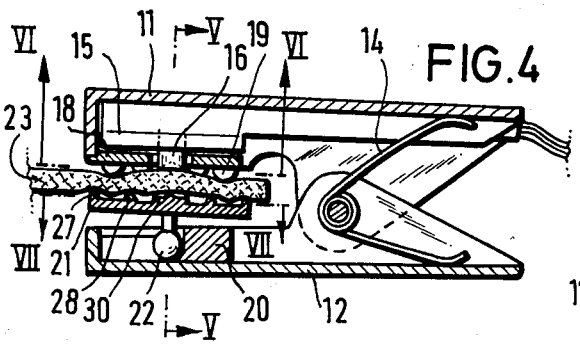
FIG.4
FIG.5
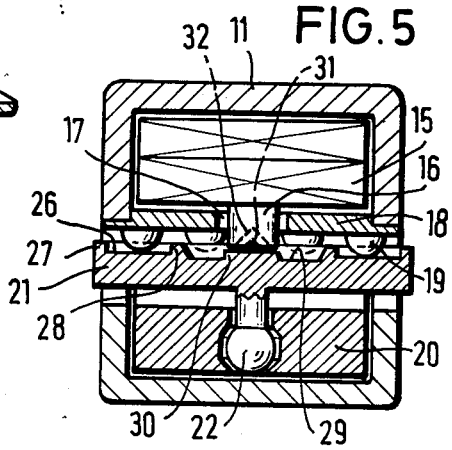
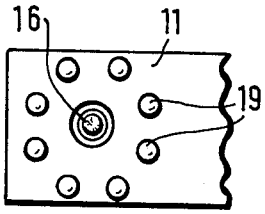
FIG.6
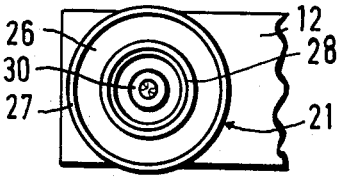
FIG.7

SAFETY CLIP FOR PROTECTING ARTICLES FROM THEFT

FIELD OF THE INVENTION

The invention relates to a safety clip for protecting textile articles etc. from theft. The clip comprises two clip legs tensioned by a spring with a first clip leg containing a pressure-responsive switch whose depressible actuator faces the second clip leg. Elevations project from the confronted clamping surfaces of the clip legs and limit in closed condition of the safety clif, a curve-shaped path for clamped web.

BACKGROUND OF THE INVENTION

Shops offering textile articles and furs are exposed to the particular risk of shop-lifting. To obviate this danger, it has been known to protect by specific clips said articles which are offered for sale. The mentioned clips are connected via a cable to an electric monitoring device. Such clips contain a switch whose switch member which is depressed by textile or fur material clamped between the clip legs disappears in a recess of the opposite clip leg if the safety clip is released. If no pressure is exerted any longer on the key surface of the switch, an alarm is triggered at the monitoring device.

Experienced shop-lifters may overcome the system of such safety clips by introducing into the gap between the clip legs a relatively stiff plastic card which is added to the textile material. While the clip is subsequently opened, the plastic card assumes the duty of depressing the switch so that the safety clip together with the rigid disk or plate depressing the switch may be removed from the article to be protected without affecting the pressure exerted on the key surface of the switch.

In other words, the theft protection system does not notice that the safety clip has been removed from the article to be protected. Since it is possible this way to switch off the known safety clips by introducing simple plates or sheets, their effectiveness is strongly reduced because experienced shop-lifters know how to remove clothes from safety clip without interfering with the operation of the switch.

German Patent 29 12 008 discloses a safety clip comprising a switch mounted at each of the two clip legs. The actuators of the switch extend in parallel in mutually spaced relationship to overlap. The ends of the clip legs include bumps provided to be offset mutually so that a curve-shaped character is imparted to the textile web which is clamped by the safety clip. Unlawful manipulations cannot be excluded by this measure either because the actuators of the switches are accessible from the side and they may be depressed by flat objects so that the fabric web may be silently withdrawn between the actuators without a response of one of the switches.

In another known safety clip, the second clip leg includes a star-shaped pressure jaw pressing the clamped fabric web against the actuator of the switch. A flap mounted at the end of the second clip leg deviates the clamped fabric. There is again the possibility of sliding a flat object between the clip legs while the operative condition of the switch is maintained to remove the clamped fabric web unnoticed from the safety clip.

It is the object of the invention to provide a safety clip of the foregoing type by which it is not possible to keep the switch depressed by inserting material so as to withdraw the clamped fabric web without a respective response of the switch.

SUMMARY OF THE INVENTION

The problem is solved according to the invention wherein the second clip leg contains a pivotally supported disk as an abutment for the clamped web. The elevations of the first and the second clip leg surround the actuator and when the safety clip is closed and empty, the elevation of at least one clip leg meets with the clamping surface of the other clip leg without an actuation of the switch.

According to the invention, the two clip legs include elevations projecting towards. The other clip leg, the elevations are arranged at both clip legs so that they do not meet mutually, i.e. one elevation of one clip leg cooperates with a space of the other clip leg that does not contain an elevation. The elevations of both clip legs are disposed around the actuator of the switch thus prohibiting the lateral insertion of a flat article into the safety clip unless the clip legs are moved apart and the switch is operated. Regardless of the thickness of the clamped fabric web, the disk always takes a position parallel to the clamping surface of the first clip leg thus ensuring peripherally from all sides the same protection against the unauthorized insertion of articles into the closed safety clip.

According to a preferred embodiment of the safety clip, the elevation of the first clip leg projects at least as far as the actuator. Due to said elevation which may consist of a closed or interrupted ring, e.g. of individual bulges arranged in a circle, it is avoided that the actuator is kept depressed by an inserted flat and rigid article, e.g. by the elevation or bulges, a flat plastic card would be kept at such a distance from the first clip leg that it will be incapable of depressing the actuator for operating the switch. On the other hand, soft textile or fur material may depress the actuator because the elevation is pressed into the fabric or fur. Hence, the switch is only responsive to compressible, soft materials rather than to rigid plates or to flexible paper which cannot be compressed sufficiently. Normally, materials to which the switch is responsive may not be easily introduced by shop-lifters into the safety clip in addition to the clamped fabric because they are too soft and, by such an attempt, the switch would be actuated at least momentarily to give alarm. Therefore, the safety clip of the invention protects articles provided therewith against unlawful removal.

According to the principle of the invention, each clip leg contains an elevation surrounding the actuator. The elevation need not be necessarily a continuous ring, but it may consist of a number of bulges distributed about the actuator to form an interrupted ring. The bulges arranged in a circle are referred to as "an elevation" to simplify matters. Such bulges may penetrate individually for a short distance into the fabric while the actuator surface resting on the fabric may be relatively large so that, due to its flexibility, it is depressed by the fabric for operating the switch.

Preferably, an elevation of the disk consists of a prominent border encompassing the upper end of the elevation (or bulge) of the first clip leg when the safety clip is closed so that is is not possible to insert a flat card into the safety clip without spreading apart the clip legs. Alternatively, or additionally, an elevation of the disk may consist of a ring having a diameter inferior to the circle formed by the elevation (or bulge) of the first clip leg.

In a preferred embodiment of the invention, the actuator is a depresable pin movable transversely with respect to its longitudinal axis and which, in depressed condition, with a lateral movement transversely to its longitudinal axis turns off the switch. If textile material is clamped by the clip, the pin is pressed in direction of its longitudinal axis into the switch. With any attempt to insert a card between the clip legs and in parallel to the textile material, while the pin is depressed the card edge will hit the pin of the switch to displace it transversely with respect to its longitudinal axis. As a result, the switch condition caused previously by the textile material is cancelled and an alarm is activated. Thus, the protection against unlawful manipulations is increased.

According to a preferred embodiment of the invention, the disk contains an attachment or actuator facing surface in alignment with the actuator. The facing surface is of such a height that it just does not actuate the actuator when the safety clip is closed and empty. By the attachment or actuator facing surface, the introduction of a rigid card between the closed clip legs is inhibited. The attachment or actuator facing surface may contain a spike disappearing in a recess of the switch element when the safety clip is closed.

FIG. 1 is a schematic perspective view showing the use of a safety clip of the invention;

FIG. 2 is a side elevational view of the safety clip shown in FIG. 1;

FIG. 3 is an elevational view of FIG. 2 from the direction of arrow III;

FIG. 4 is a longitudinal sectional view of the safety clip of the invention;

FIG. 5 is a sectional view along line V—V of FIG. 4, the safety clip being closed and empty;

FIG. 6 is a sectional view of the first clip leg from the direction of the line IV—IV of FIG. 4; and FIG. 7 is a sectional view of the second clip leg from the direction of arrow VII—VII of FIG. 4.

DETAILED DESCRIPTION

The illustrated safety clip 10 comprises two legs 11,12 having both a U-shaped cross section and being hinge-connected by an articulated axle 13. A spring 14 seated on axle 13 spreads apart the rear ends of the clip legs 11,12 so that their front ends are pressed against one another. Electric switch 15 secured to the front portion of the first clip leg 11, has an actuator 16 confronted with the other clip leg 12. Switch 15 is mounted inside the first clip leg 11 and covered by a plate 18 having an aperture 17 for the passage of the actuator 16. The plate 18 includes an elevation in the form of a plurality of bulges 19 arranged in a circle around the actuator and projecting from the plate 18 towards the second clip leg 12.

As evident from FIGS. 4 and 5, the actuator pin 16 may not only be pressed into switch 15, but it may be also swivelled laterally in the aperture 17. If the actuator 16 is depressed axially, the switch will be actuated. If the actuator 16 is displaced laterally now, the switch will become inoperative. In other words, by an attempt of sliding a flat article in parallel to the fabric 23 between the clip legs, the edge of the article will hit the actuator 16, which will take an inclined position so that the switch 15 will become inoperative (open). The rest position or inoperativeness of switch 15 corresponds to an open clip or to the condition in which no fabric is between the clip legs.

The second clip leg 12 includes a holder 20 to which a disk 21 is secured by a ball joint 22. Disk 21 consists of a plate swivable or pivotally supported about the ball joint 22 center in longitudinal direction of the clip 10 and adapted to adjust itself always in parallel to the plane in which the bulges 19 are situated. By this means, the disk 21 may be accomodated or adjusted automatically to any thickness elevation or bulges 19. Thus, each bulge 19 of the first clip leg 11 necessarily is confronted with a face of the disk 21 of the second clip leg 12.

Referring to FIG. 5, if safety clip 10 is empty and closed (i.e. without clamping textile material 23), the bulges 19 abut against the clamping surface 26 of the disk 21. Clamping surface 26 is surrounded by a continuously circumjacent and elevated border ring 27. An elevated inner ring 28 is concentric to border ring 27 and extends inside the circle on which bulges 19 of the first clip leg 11 are situated. Thus, bulges 19 project into the space between the border ring 27 and the inner ring 28. Ring 28 encloses a depression 29 whose bottom is deeper than the clamping surface 26. An attachment or actuator facing surface 30 has a height inferior to that of ring 28, projects upwardly from the depression 29 and is in alignment with actuator 16. In case of an empty safety clip 10, actuator 16 just contacts the top of the attachment or facing surface 30, the switch 15 thereby being precisely inoperative. A vertical spike 31 in the center of the attachment or actuator forcing surface 30 disappears in a trough 32 of the end side of the actuator 16.

In the alternative, a spike may be located on the outer end surface of actuator 16 with a trough located on actuator facing surface 30 to receive such spike.

As shown in FIG. 4, under the action of spring 14, the bulges 19 forming the elevation penetrate into and press the underside of fabric 23 against the clamping surface 26 causing fabric 23 to deformed between the border ring 27 and the inner ring 28. Attachment or actuator surface 30 lifts fabric 23 within the range of the actuator 16, which, while its end side, in rest condition, does not exceed the bulges 19, is depressed by the bulged fabric 23 into the switch 15 being actuated accordingly.

If one tries to slide a thin stiff strip of plastics or metal between the bulges 19 and the fabric material 23, the switch 15 will be put off because the stiff strip would find its support on the bulges 19. The actuator 16 cannot be depressed by a stiff, flat strip.

Cable 24 connects switch 15 to an electric monitor 25 and is of the four-wire type and includes in addition to the signal circuit traversing the switch 15, a second circuit monitored for rest current. In other words, it is not possible to outwit the monitor 25 by short-circuiting two wires of the cable 24.

The switch 15 of the safety clip 10 of the invention is only actuated if, between the clip legs 11,12, a soft, depressible material is present into which the bulges 19 may penetrate. However, it is not possible, while a textile material 23 is present in the clip, to insert such soft material into the safety clip in a malicious intention.

Tests have shown that switch 15 does not respond to sheet metals, plastic cards and paper which are slided between the clip legs, while it will respond to textile material present between said legs. Such a textile material may be of a relatively reduced thickness. As a matter of fact, e.g. the switch is already responsive to canvas or silk.

While the safety clip for protecting articles from theft has been shown and described in detail, it is obvious that this invention is not to be considered as limited to the exact form disclosed, and that changes in detail and construction may be made therein within the scope of the invention without departing from the spirit thereof.

What is claimed is:

1. A safety clip device for protecting textile articles and the like from theft, said device comprising:
(a) two clip legs having confronting clamping surfaces and being tensioned to a closed position by biassing means,
(b) a first of the clip legs contains a fixedly mounted pressure-responsive switch means having a depressible actuator facing the second of the clip legs and projecting outwardly from one of the confronting clamping surfaces and,
(c) elevations projecting from the confronted clamping surfaces of the clip legs and limiting a curve-shaped path for a clamped fabric web when the safety clip is in the closed position which clamped fabric causes the actuator to be depressed thereby activating the switch means,
(d) the second clip leg including pivotally supported disk means being movable with respect to the switch means and having a top surface for contacting and adjusting to the thickness of the clamped web,
(e) the elevations including projections on the first and second clip legs surrounding the actuator to preclude maintaining of the activated switch means upon unauthorized removal of the clamped web,
(f) the elevation of at least one clip leg meets with the clamping surface of the other clip leg without depressing the actuator to prohibit actuation of the switch means when the safety clip is empty and in a closed position.

2. A safety clip device as defined in claim 1 wherein an elevation of the first clip leg projects at least as far as the actuator which projects from the first clip leg.

3. A safety clip device as defined in claim 1 wherein the elevations include an elevated outer border located on the disk means.

4. A safety clip device as defined in claim 3 wherein the elevations form a circle around the actuator on the clamping surface of the first clip leg and include a ring on the disk means having a diameter smaller than the circle of the elevation on the first clip leg.

5. A safety clip device as defined in claim 4 wherein the elevations include an elevated outer border located on the disk means.

6. A safety clip device as defined in claim 1 wherein the elevations include a plurality of bulges distributed around the actuator on the first clip leg.

7. A safety clip device as defined in claim 1 wherein the actuator is a depressible pin which is movable transversely with respect to its longitudinal axis and is effective to turn off said switch means with a lateral movement transversely to its longitudinal axis when the pin is in a depressed condition.

8. A safety clip device as defined in claim 1 wherein said disk means has a top surface including an actuator facing surface in alignment with the actuator, said facing surface has such a height that the actuator is not operated when the safety clip is closed and empty.

9. A safety clip device as defined in claim 8 wherein the actuator has an outer end surface and includes a trough at the outer end surface,
the actuator facing surface includes a spike which disappears in the trough of the actuator when the safety clip is closed.

10. A safety clip device as defined in claim 8 wherein the actuator facing surface includes a trough, and
the actuator has an outer end surface and includes a spike at the outer end surface which spike disappears in the trough when the clip device is in a closed position.

11. A safety clip device as defined in claim 1 wherein the disk means includes swivel joint means for pivotally supporting the disk means on the second clip leg.

12. A safety clip device for protecting textile articles and the like from theft, said device comprising:
(a) two clip legs having confronting clamping surfaces and being tensioned to a closed position by biassing means,
(b) a first of the clip legs contains a pressure-responsive switch having a depressible actuator facing the second of the clip legs, and
(c) elevations projecting from the confronted clamping surfaces of the clip legs and limiting a curve-shaped path for a clamped fabric web when the safety clip is in the closed position,
(d) the second clip leg including pivotally supported disk means having a top surface for contacting the clamped web,
(e) the elevations including projections on the first and second clip legs surrounding the actuator,
(f) the elevation of at least one clip leg meets with the clamping surface of the other clip leg without an actuation of the switch when the safety clip is empty and in a closed position,
(g) said disk means has a top surface including an actuator facing surface in alignment with the actuator,
(h) said facing surface has such a height that the actuator is not operated when the safety clip is closed and empty,
(i) the actuator has an outer end surface and includes a trough at the outer end surface, and
(j) the actuator facing surface includes a spike which disappears in the trough of the actuator when the safety clip is closed.

13. A safety clip device for protecting textile articles and the like from theft, said device comprising:
(a) two clip legs having confronting clamping surfaces and being tensioned to a closed position by biassing means,
(b) a first of the clip legs contains a pressure-responsive switch having a depressible actuator facing the second of the clip legs, and
(c) elevations projecting from the confronted clamping surfaces of the clip legs and limiting a curve-shaped path for a clamped fabric web when the safety clip is in the closed position,
(d) the second clip leg including pivotally supported disk means having a top surface for contacting the clamped web,
(e) the elevations including projections on the first and second clip legs surrounding the actuator,
(f) the elevation of at least one clip leg meets with the clamping surface of the other clip leg without an actuation of the switch when the safety clip is empty and in a closed position, (g) said disk means has a top surface including an actuator facing surface in alignment with the actuator, (h) said facing surface has such a height that the actuator is not operated when the safety clip is closed and empty, (i) the actuator facing surface includes a trough, and (j) the actuator has an outer end surface and includes a spike at the outer end surface which spike disappears in the trough when the clip device is in a closed position.

* * * * *